US007530821B2

(12) United States Patent
Miyake

(10) Patent No.: US 7,530,821 B2
(45) Date of Patent: May 12, 2009

(54) INDICATOR FOR CONNECTOR

(75) Inventor: Michihiro Miyake, Saitama-ken (JP)

(73) Assignee: FUJIFILM Corporation, Tokyo (JP)

( * ) Notice: Subject to any disclaimer, the term of this patent is extended or adjusted under 35 U.S.C. 154(b) by 0 days.

(21) Appl. No.: 11/759,744

(22) Filed: Jun. 7, 2007

(65) Prior Publication Data

US 2007/0227053 A1 Oct. 4, 2007

Related U.S. Application Data

(62) Division of application No. 10/769,792, filed on Feb. 3, 2004.

(30) Foreign Application Priority Data

Feb. 4, 2003 (JP) ..... 2003-26647

(51) Int. Cl.
*H01R 12/00* (2006.01)

(52) U.S. Cl. ..... 439/135; 439/491; 439/932; 439/936; 29/873

(58) Field of Classification Search ..... 439/490, 439/491, 932, 936, 135; 53/411; 29/873
See application file for complete search history.

(56) References Cited

U.S. PATENT DOCUMENTS

| | | | | |
|---|---|---|---|---|
| 905,349 | A | 12/1908 | Neal et al. | |
| 1,949,141 | A * | 2/1934 | Blaylock | 40/662 |
| 3,281,056 | A | 10/1966 | Kugler | |
| 4,658,504 | A * | 4/1987 | Sinharoy et al. | 29/873 |
| 5,090,559 | A | 2/1992 | Gendreau | |
| 5,470,253 | A * | 11/1995 | Siems et al. | 439/491 |
| 6,591,583 | B2 * | 7/2003 | Dickey et al. | 53/411 |
| 6,811,027 | B2 | 11/2004 | Alexander | |
| 2001/0039141 | A1 * | 11/2001 | Katwala | 439/491 |
| 2003/0027445 | A1 * | 2/2003 | Carney et al. | 439/135 |
| 2004/0241065 | A1 * | 12/2004 | Kampa et al. | 422/305 |
| 2007/0089989 | A1 * | 4/2007 | Hoagland et al. | 204/424 |

FOREIGN PATENT DOCUMENTS

| | | | |
|---|---|---|---|
| JP | 49-14390 | | 2/1974 |
| JP | 49-16832 | | 2/1974 |
| JP | 5-299129 | A | 11/1993 |
| JP | 09-249254 | | 9/1997 |
| JP | 11-67323 | | 3/1999 |
| JP | 2001-5393 | A | 1/2001 |
| JP | 3076080 | U | 3/2001 |
| JP | 2002-541498 | | 12/2002 |
| WO | 01/12518 | | 2/2001 |

* cited by examiner

*Primary Examiner*—Hien Vu
(74) *Attorney, Agent, or Firm*—Sughrue Mion, PLLC

(57) ABSTRACT

An indicator for a connector, which is attached to a connector, has a first indication member at which is indicated first information urging a user to perform a predetermined operation before using the connector, and which is attached to a position such that the connector cannot be connected if the user does not remove the indicator for a connector, and which can be removed from the connector. The indicator for a connector also has a second indication member at which is indicated second information which is useful at a time of connecting the connector, the second indication member being attached to a position which does not impede connection of the connector.

6 Claims, 15 Drawing Sheets

INDICATOR FOR CONNECTOR

CROSS-REFERENCE TO RELATED APPLICATION

This is a divisional of U.S. application Ser. No. 10/769,792, filed Feb. 3, 2004, which is incorporated herein by reference in its entirety. This application claims the benefit of Japanese Patent Application No. 2003-26647, the disclosure of which is incorporated herein by reference.

BACKGROUND OF THE INVENTION

1. Field of the Invention

The present invention relates to an indicator for a connector which is attached to a connector.

2. Description of the Related Art

Various indicators have conventionally been used in order to provide a user with given precautions when the user connects a connector. For example, in Japanese Utility Model No. 3076080, as shown in FIG. 13, a hot water plug 100 is covered by a protective cover 102 serving as an indicator, and warnings relating to the hot water plug 100 are written on the protective cover 102. In this way, the user is provided with given precautions. Moreover, in Japanese Patent Application Laid-Open (JP-A) No. 2001-5393, as shown in FIG. 14, a tag indicator 112, which serves as an indicator indicating the name of the device to which a plug 110 is attached, is attached to the cable portion of the plug 110. In this way, the user is informed of what device the plug 110 is for. In addition, in JP-A No. 5-299129, as shown in FIG. 15, a cover sheet 126, which serves as an indicator on which a predetermined note is written, is provided at a connector 124 of a device 122 ahead to which a cable connector 120 is connected. The user is provided with a predetermined precaution by this written note.

There are some electronic devices for which the user must carry out a predetermined operation one time before connecting that electronic device with another electronic device by a cable and using the devices. However, in the techniques disclosed in Japanese Utility Model No. 3076080 and JP-A No. 2001-5393, even if the user is urged to carry out the predetermined operation, the notification is insufficient for the user, since the user can connect the connector without removing the indicator. Moreover, in the technique disclosed in JP-A No. 5-299129, because the connector is covered by the indicator, the user must move the indicator at the time of connecting the connector. However, when the connector is not being used, the indicator is always at a position of covering the portion for connecting the connector. Therefore, there is the problem that even after the predetermined operation has been carried out, the user is urged to carry out that predetermined operation.

SUMMARY OF THE INVENTION

In view of the aforementioned, an object of the present invention is to provide an indicator for a connector which can urge a user to carry out a predetermined operation only one time before use.

A first aspect of the present invention provides an indicator for a connector which is attached to a connector, the indicator for a connector comprising: a first indication member at which is indicated first information urging a user to perform a predetermined operation before using the connector, and which is attached to a position such that the connector cannot be connected if the user does not remove the indicator for a connector, and which can be removed from the connector.

The first indication member of the indicator for a connector of the present invention can be removed from the connector, and is attached to a position such that the connector cannot be connected if a user does not remove the indicator for a connector. Thus, when a user is to use the connector, he/she must remove the first indication member. First information, which urges the user to carry out a predetermined operation before using the connector, is indicated on the first indication member. Accordingly, in accordance with the indicator for a connector, the user can be effectively urged to perform the predetermined operation before using the connector. Moreover, because the first indication member is removed by the user at the time when the user is to use the connector, the user is not urged to carry out that predetermined operation when he/she uses the connector thereafter. Accordingly, the user can be urged a single time to perform the predetermined operation before using the connector.

The indicator for a connector of the first aspect may further comprise a second indication member at which is indicated second information which is useful at a time of connecting the connector, the second indication member being attached to a position which does not impede connection of the connector.

In accordance with this indicator for a connector, the second indication member is attached to a position which does not impede connection of the connector. Therefore, there is no need to remove the second indication member. The second information is provided to the user at times when the user uses the connector. Note that the second information may be, for example, the name of the device to which the connector is to be attached, items to be noted at the time of using the connector, and the like.

Moreover, the first indication member and the second indication member are structured integrally, and each of the first indication member and the second indication member can be separated.

By structuring the first indication member and the second indication member integrally in this way, manufacturing is easy. Moreover, because each of the first indication member and the second indication member can be separated, the second indication member can remain attached to the connector even after the first indication member has been removed.

A second aspect of the present invention provides a method of manufacturing an indicator for a connector which is attached to a connector, the method comprising the steps of: forming a first indication member at which is indicated first information urging a user to perform a predetermined operation before using the connector, the first indication member being structured so as to be removable from the connector; and forming a second indication member at which is indicated second information which is useful at a time of connecting the connector, the second indication member being structured so as to be attached to a position which does not impede connection of the connector.

DETAILED DESCRIPTION OF THE INVENTION

First Embodiment

A cable 30 (see FIG. 1) in the present embodiment is a cable for, for example, connecting a digital camera to an external device (neither of which is illustrated). When the digital camera and the external device are connected by the cable 30 and processing such as downloading of data or the like from the digital camera to the external device is to be carried out, the user must install software of a predetermined CD-ROM in the external device.

Figure 1:
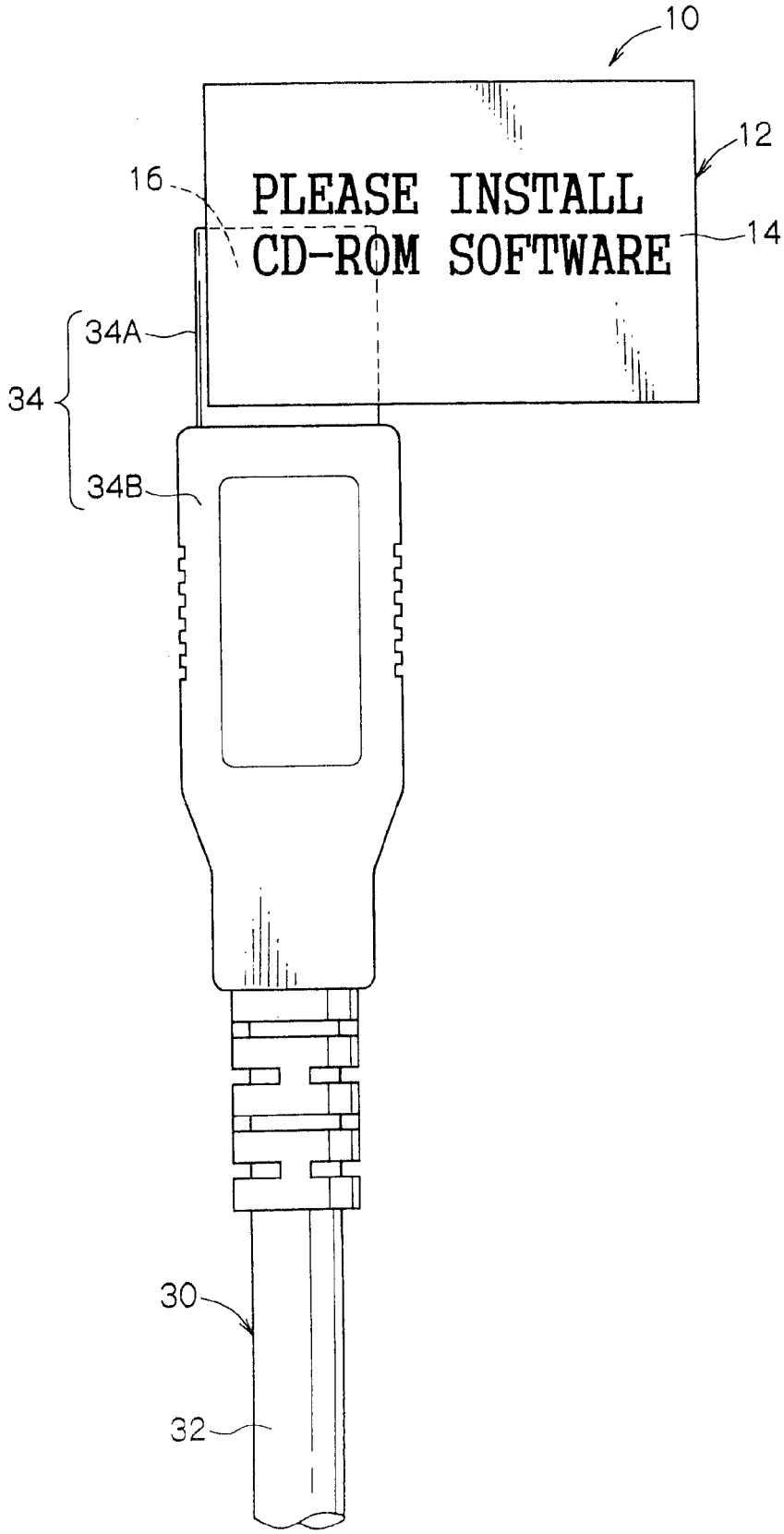
FIG. 1 is a front view of an indicator for a connector of a first embodiment of the present invention.

As shown in FIG. 1, the cable 30 has a cable portion 32 and a connector 34. The connector 34 is provided at one end portion of the cable 30, and has a connecting portion 34A and a grasping portion 34B. The connecting portion 34A is the portion which is inserted into the connector corresponding to the external device. The grasping portion 34B is disposed between the connecting portion 34A and the cable portion 32, and is the portion which the user grasps at the time of attaching and at the time of removing the connector 34.

As shown in FIG. 1, an indicator 10 for a connector is structured by a first indication member 12. Information urging the user to carry out a predetermined operation before using the connector (in the present embodiment, first information urging the user to install the software of a CD-ROM before using the connector) is indicated on an obverse 14 of the first indication member 12. An adhesive is applied to an adhesion portion 16 at the reverse surface of the first indication member 12.

The first indication member 12 is preferably subjected to antistatic finishing.

The first indication member 12 is adhered, via the adhesive applied to the adhesion portion 16, to the connecting portion 34A of the connector 34. Accordingly, if the first indication member 12 is not removed, it is not possible to connect the connector 34 to a connection terminal corresponding to the external device. The first indication member 12 can be peeled off from the connector 34 by the user.

Next, operation of the present embodiment will be described.

When the user connects a digital camera and an external device by using the cable 30, the user connects the connector 34 to the connector corresponding to the external device. At this time, the user must peel the first indication member 12 of the indicator 10 for a connector off of the connector 34. However, the first information, which urges the user to perform the work of installing the software of the CD-ROM before using the connector, is displayed on the obverse 14 of the first indication member 12.

Accordingly, in accordance with the above-described indicator 10 for a connector, the user can be effectively urged to carry out the work of installing the software of the CD-ROM in the external device before using the connector.

Moreover, once the software is installed in the external device, there is no longer the need to again urge the user to install the software. In accordance with the present embodiment, the first indication member 12 is removed by the user at the time when the user uses the connector 34. Accordingly, when the connector 34 is used thereafter, the user is not urged to install the software, and the user can be urged to install the software a single time before using the connector 34.

Figure 2A:
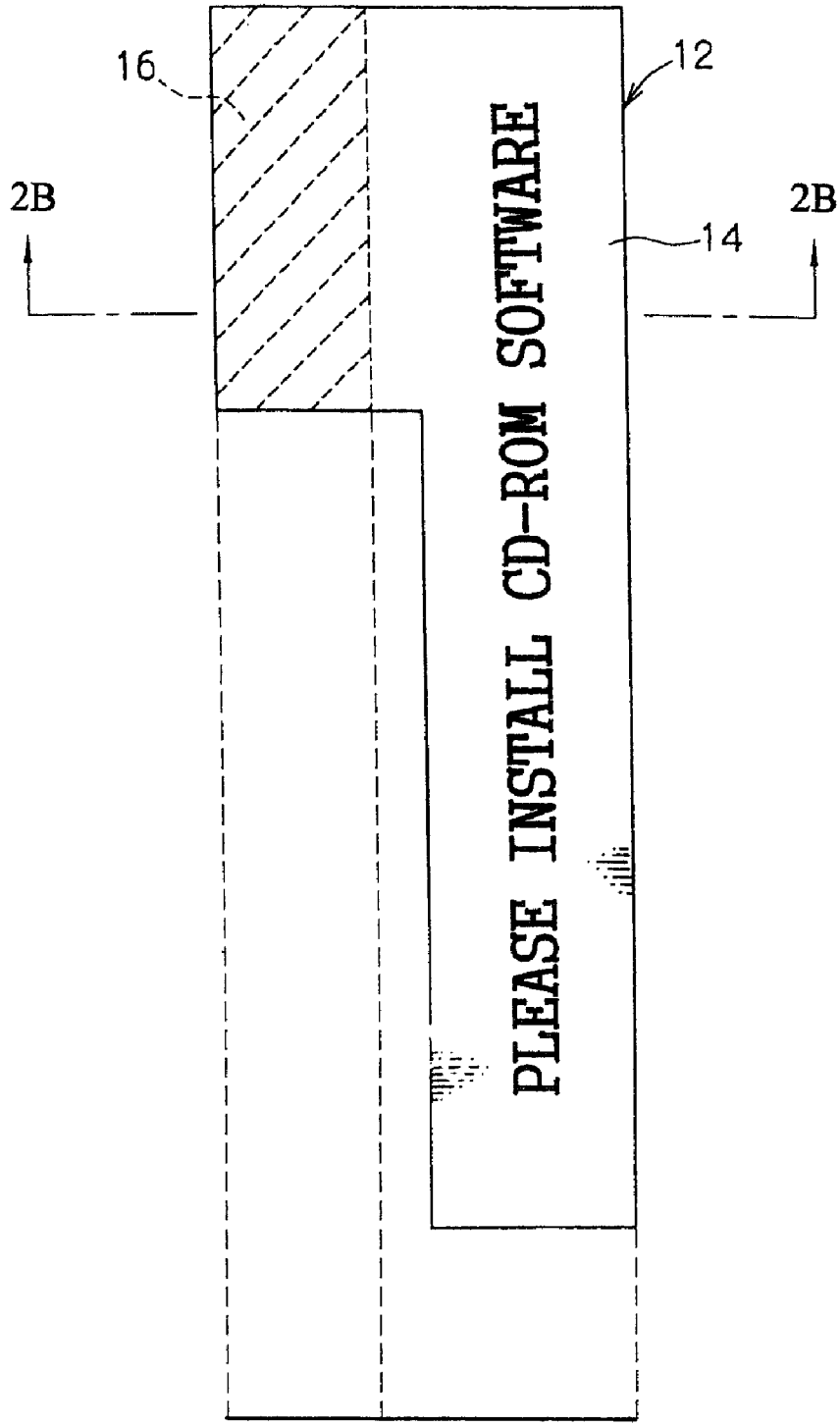
FIG. 2A is a top view showing a modified example of the indicator for a connector of FIG. 1.
Figure 2B:
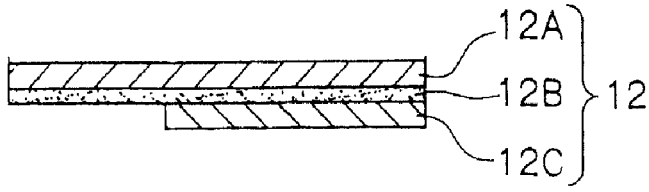
FIG. 2B is a sectional view along X-X of FIG. 2A.

Note that, an example is described above in which an adhesive is applied to the adhesion portion 16, and the first indication member 12 is adhered to the connecting portion 34A. However, the first indication member 12 can be structured as shown in FIG. 2A and 2B, and can be adhered to the connecting portion 34A. Namely, the first indication member 12 is structured such that an indication layer 12A at which the first information is displayed, an adhesive layer 12B formed from an adherable member, and a peeling layer 12C which covers the adhesive layer 12B and can be peeled-off, are laminated together. The peeling layer 12C of the adhesion portion 16 is peeled off from the adhesive layer 12B so as to expose the adhesive layer 12B, and the first indication member 12 is adhered to the connecting portion 34A. With such a structure, there is no need to apply an adhesive to a portion of the first indication member 12, and a portion of the first indication member 12 can be made to have an adhesive function by a simple method.

Figure 3:
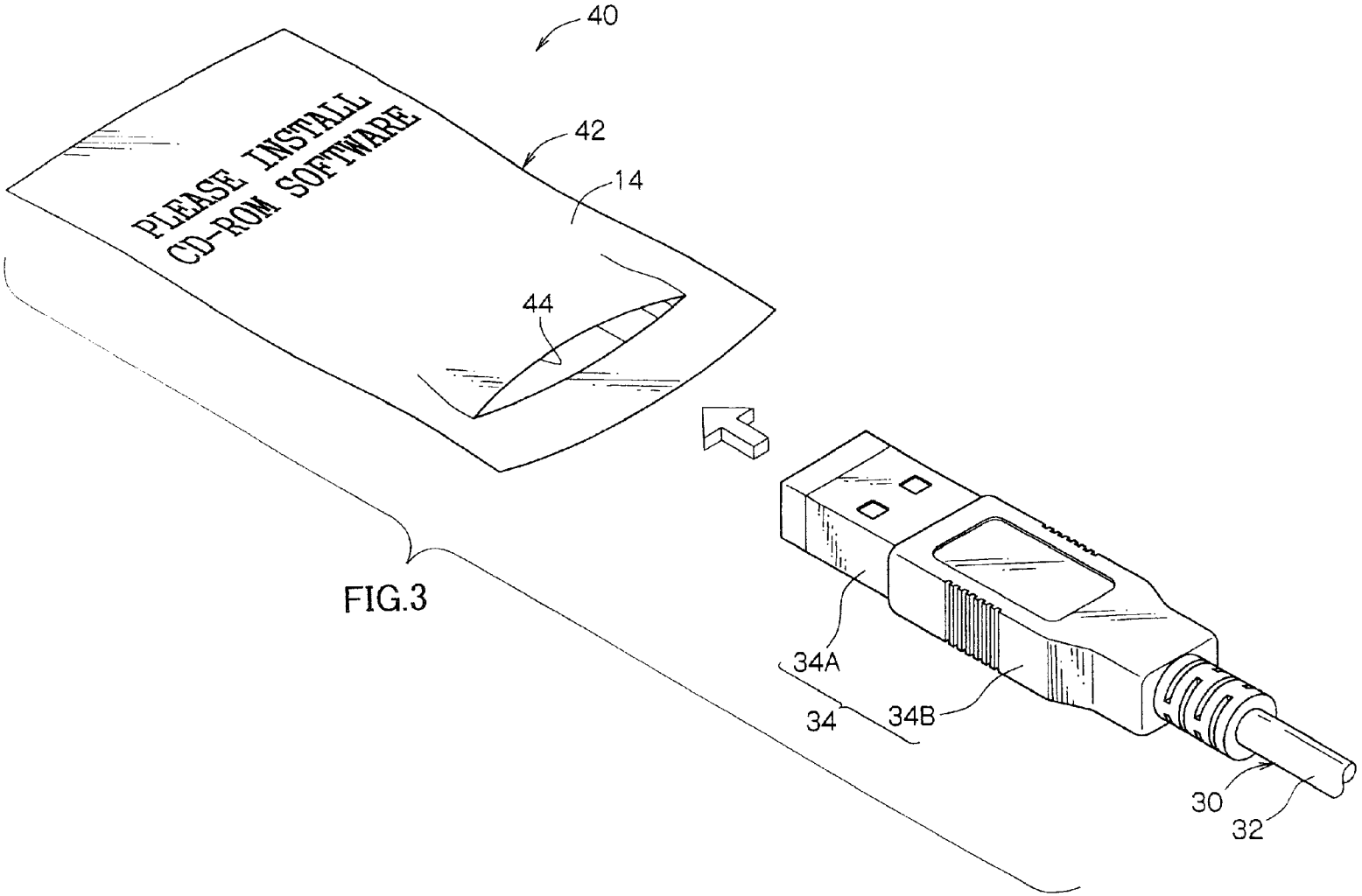
FIG. 3 is a perspective view showing another modified example of the indicator for a connector of FIG. 1.

Moreover, the configuration of the first indication member is not limited to the above-described configurations. For example, a bag shape may be used as in the case of a first indication member 42 shown in FIG. 3. In this case, a slit is formed in the obverse 14 of the first indication member 42 so as to form an opening 44. By inserting the connecting portion 34A of the connector 34 into the first indication member 42 from the opening 44, an indicator 40 for a connector is attached to the connector 34. In accordance with this structure, the connector 34 can be covered, and it is possible to prevent dirt or the like from adhering to the connector 34.

Figure 4:
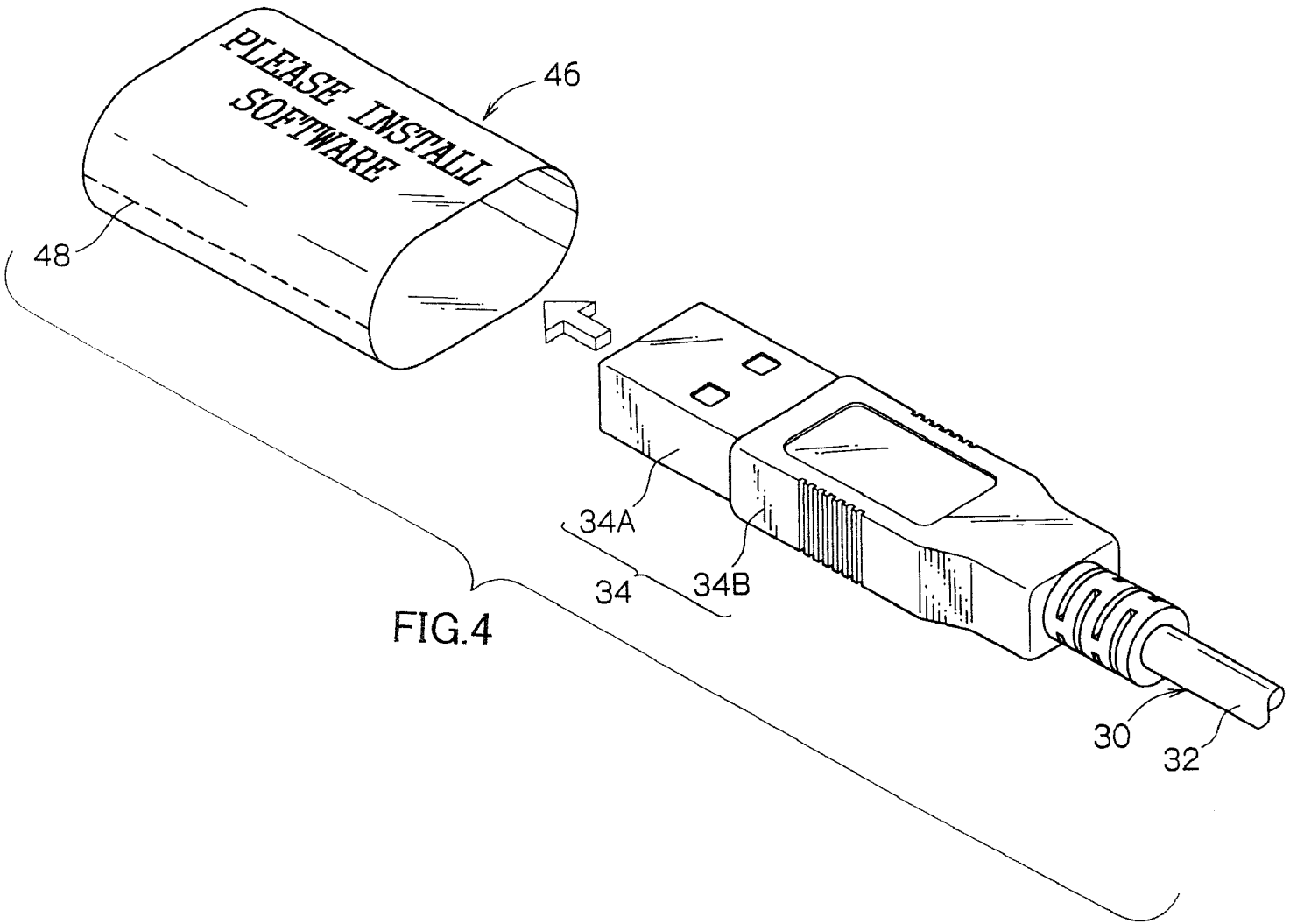
FIG. 4 is a perspective view showing yet another modified example of the indicator for a connector of FIG. 1.
Figure 5A:
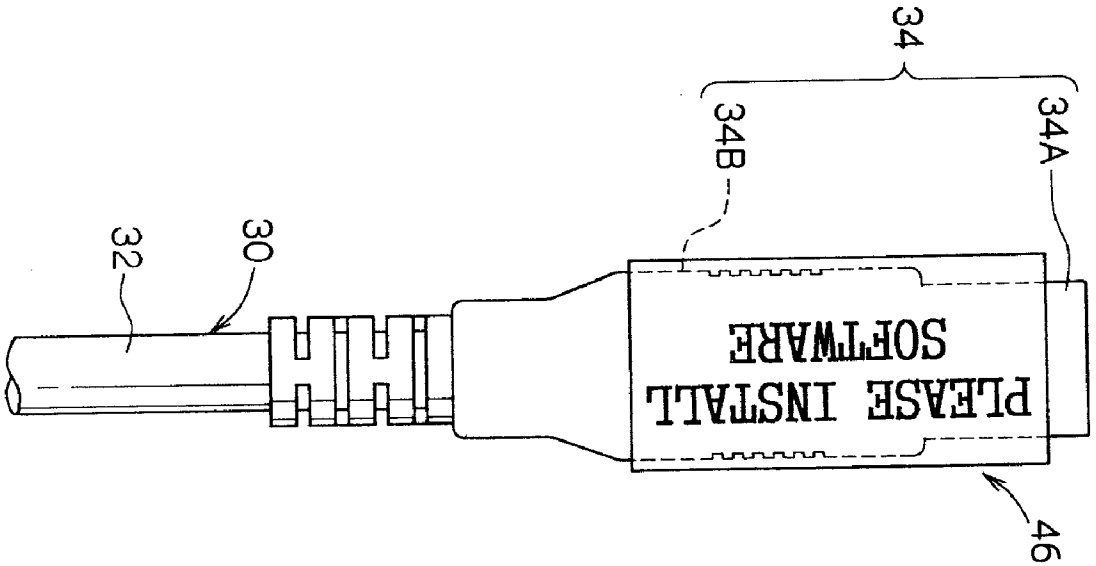
FIG. 5A is a front view explaining attachment, to a connector, of the indicator for a connector shown in FIG. 4.
Figure 5B:
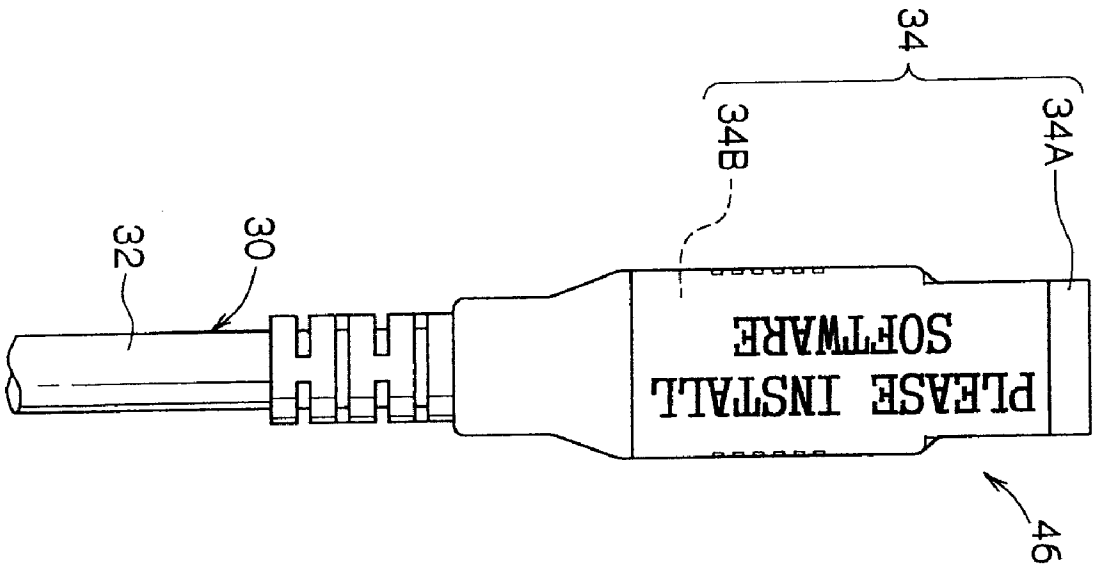
FIG. 5B is a front view explaining attachment, to the connector, of the indicator for a connector shown in FIG. 4.

Moreover, a tube shape may be used as in the case of a first indication member 46 shown in FIG. 4. In this case, the first indication member 46 is formed by a member which can be shrunk by heat, and a perforation 48 is formed at the side portion thereof. Then, as shown in FIG. 5A, after the connector 34 is inserted into the tube of the first indication member 46, the first indication member 46 is heated and shrunk such that, as shown in FIG. 5B, the first indication member 46 closely contacts the connector 34. When the first indication member 46 is to be removed from the connector 34, the user can remove the first indication member 46 by ripping the perforation 48 apart.

Figure 6:
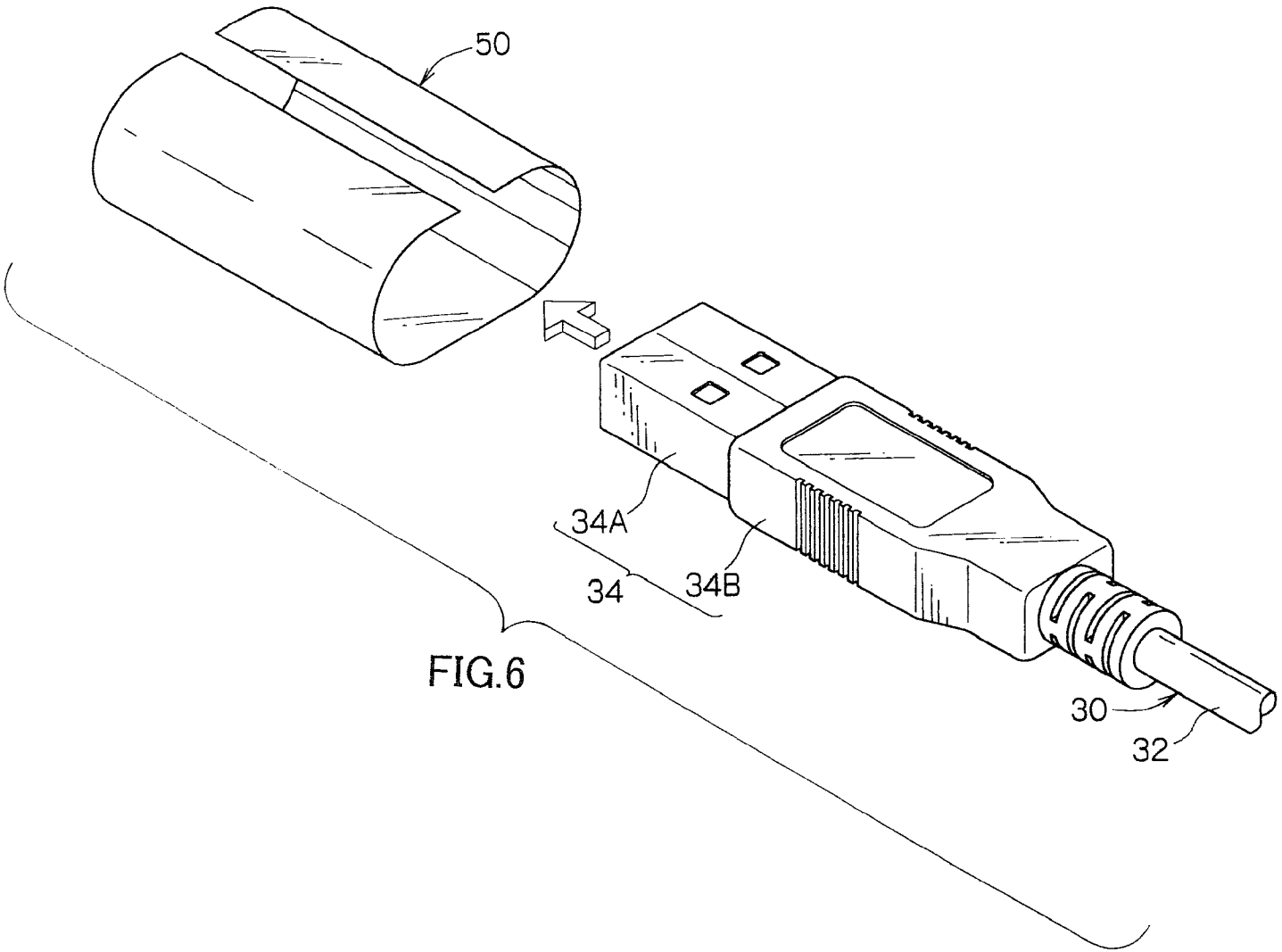
FIG. 6 is a perspective view showing a modified example of the indicator for a connector shown in FIG. 4.

Moreover, as in the case of a first indication member 50 shown in FIG. 6, a structure is possible in which a portion of the reverse side of the above-described first indication member 46 is cut away. In this case as well, the first indication member 50 is attached to the connector 34 in the same way as the above-described first indication member 46. Further, removal of the first indication member 50 from the connector 34 by the user can be carried out without tearing apart a perforation.

Note that the first indication members 46, 50 shown in FIGS. 4 and 6 may be adhered and attached to the connecting portion 34A of the connector 34 via an adhesive, rather than by being heat shrunk.

Figure 7:
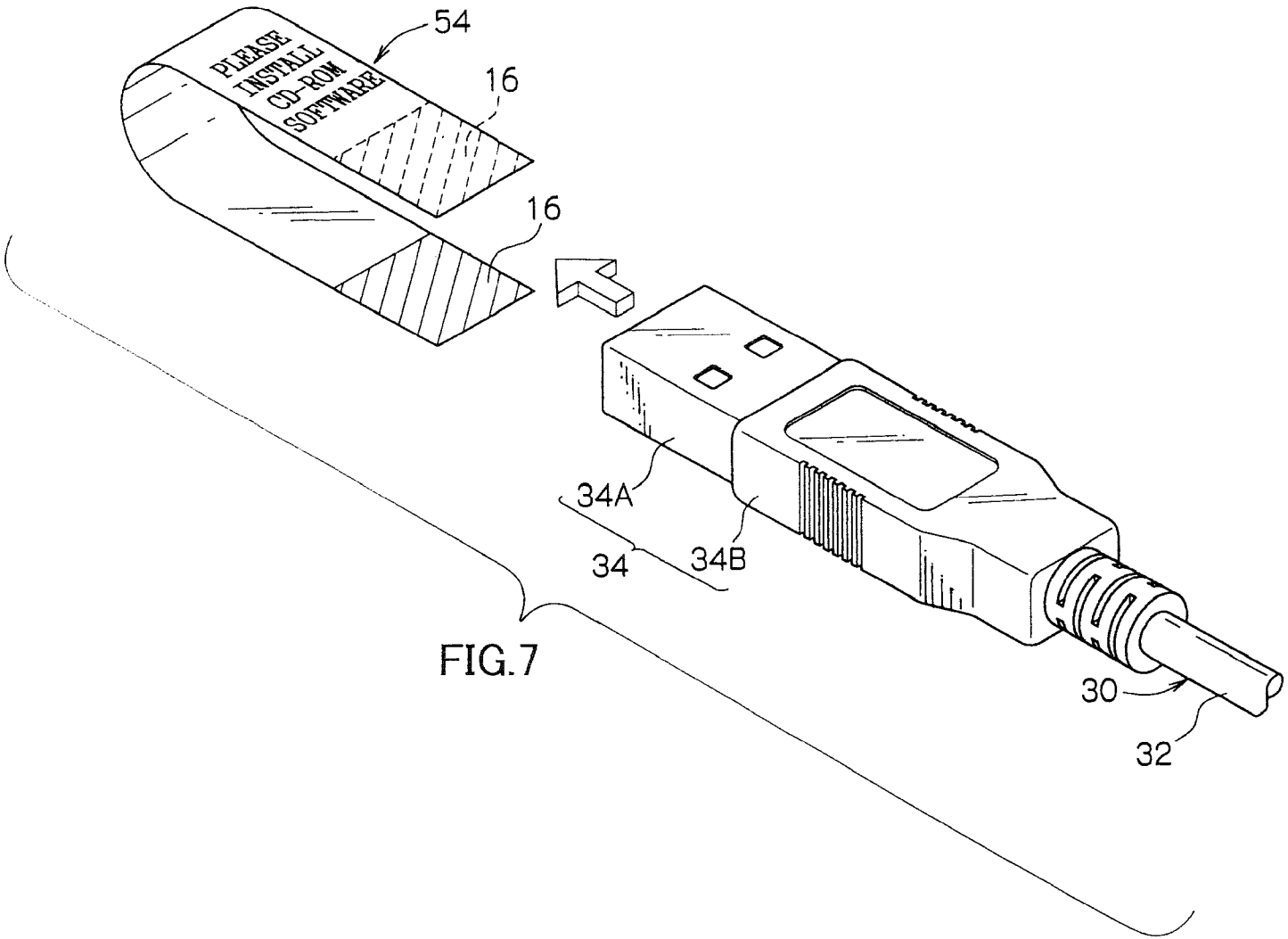
FIG. 7 is a perspective view showing still yet another modified example of the indicator for a connector of FIG. 1.

Moreover, a U-shape may be utilized as in the case of a first indication member 54 shown in FIG. 7. In this case, the adhesion portions 16 are provided at the inner sides of the both end portions of the U. An adhesive is applied to the adhesion portions 16, and the adhesion portions 16 are adhered to the connecting portion 34A such that the first indication member 54 is attached to the connector 34.

Second Embodiment

Next, a second embodiment will be described. In the present embodiment, portions which are similar to those of the first embodiment are denoted by the same reference numerals, and detailed description thereof is omitted.

Figure 8A:
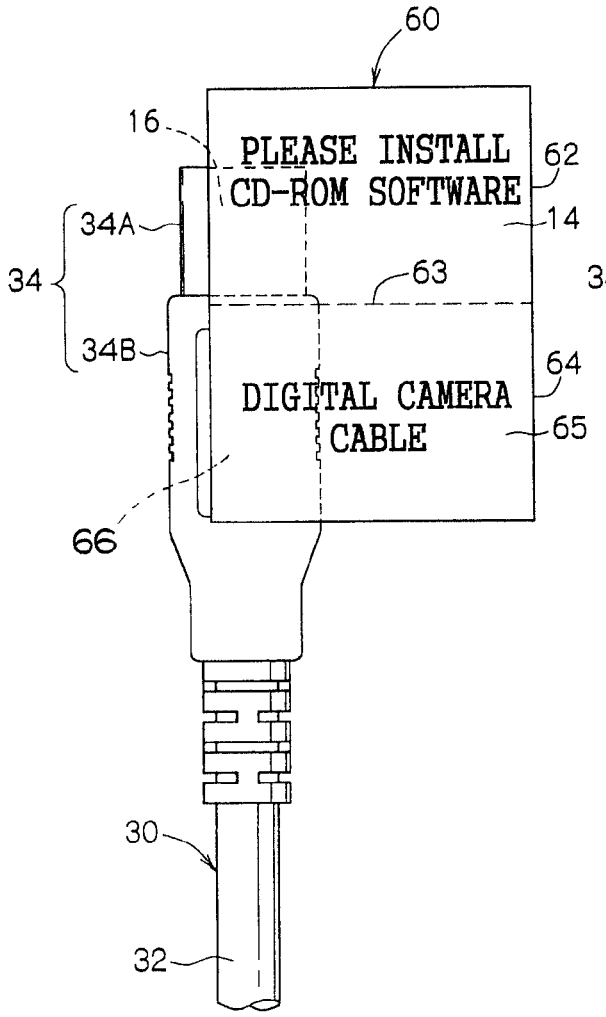
FIG. 8A is a front view of an indicator for a connector of a second embodiment of the present invention.

As shown in FIG. 8A, an indicator 60 for a connector of the second embodiment is structured by a first indication member 62 and a second indication member 64. The first indication member 62 and the second indication member 64 are formed integrally by a single sheet, and can be separated by a perforation 63.

Information urging the user to carry out a predetermined operation before using the connector is indicated on the obverse 14 of the first indication member 62. For example, in the present embodiment, first information urging the user to install the software of a CD-ROM before using the connector is displayed. An adhesive is applied to the adhesion portion 16 at the reverse surface of the first indication member 62.

Information which is useful to the user each time the connector 34 is connected is displayed on an obverse 65 of the second indication member 64. For example, in the present embodiment, second information, which clearly expresses that the cable 30 is the cable of a digital camera, is displayed. An adhesive is applied to an adhesion portion 66 at the reverse surface of the second indication member 64.

The first indication member 62 is adhered to the connecting portion 34A of the connector 34 via the adhesive applied to the adhesion portion 16. The second indication member 64 is adhered to the grasping portion 34B of the connector 34 via the adhesive applied to the adhesion portion 66. Accordingly, if the first indication member 62 is not removed, the connector 34 cannot be connected to a connector corresponding to an external device. The first indication member 62 can be peeled off from the connector 34 by the user.

Note that the strength of the adhesion of the second indication member 64 to the grasping portion 34B is preferably stronger than the strength of adhesion of the first indication member 62 to the connecting portion 34A. The first indication member 62 can be peeled off by the user, whereas the second indication member 64 is used while still adhered to the grasping portion 34B without being peeled off therefrom. Therefore, the second indication member 64 is adhered at a strength such that it cannot easily be peeled off.

Next, operation of the present embodiment will be described.

At the time when the user connects the digital camera and the external device by using the cable 30, the user connects the connector 34 to the connector corresponding to the external device. At this time, the first indication member 62 of the indicator 60 for a connector must be separated by the user from the second indication member 64 at the perforation 63, and peeled off from the connector 34. The first information, which urges the user to perform the operation of installing the software of the CD-ROM before using the connector, is displayed on the obverse 14 of the first indication member 12.

Accordingly, in accordance with the above-described indicator 60 for a connector, the user can effectively be urged to carry out the work of installing the software of the CD-ROM in the external device before using the connector.

Moreover, once the software is installed in the external device, there is no longer the need to again urge the user to install the software. Therefore, in accordance with the present embodiment, the first indication member 62 is removed by the user at the time when the user uses the connector 34. Accordingly, when the connector 34 is used thereafter, the user is not urged to install the software, and the user can be urged to install the software a single time before using the connector 34.

Figure 8B:
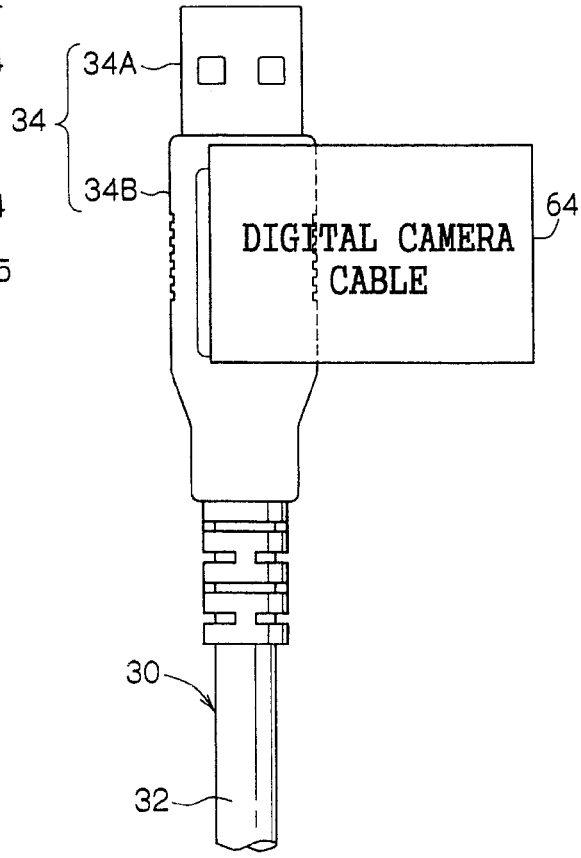
FIG. 8B is a front view of the indicator for a connector of the second embodiment of the present invention.

Moreover, as shown in FIG. 8B, even after the first indication member 62 has been removed, the second indication member 64 remains attached to the grasping portion 34B of the connector 34. Therefore, it can be made clear to the user that the cable 30 provided at the connector 30 is a cable for a digital camera.

Figure 9A:
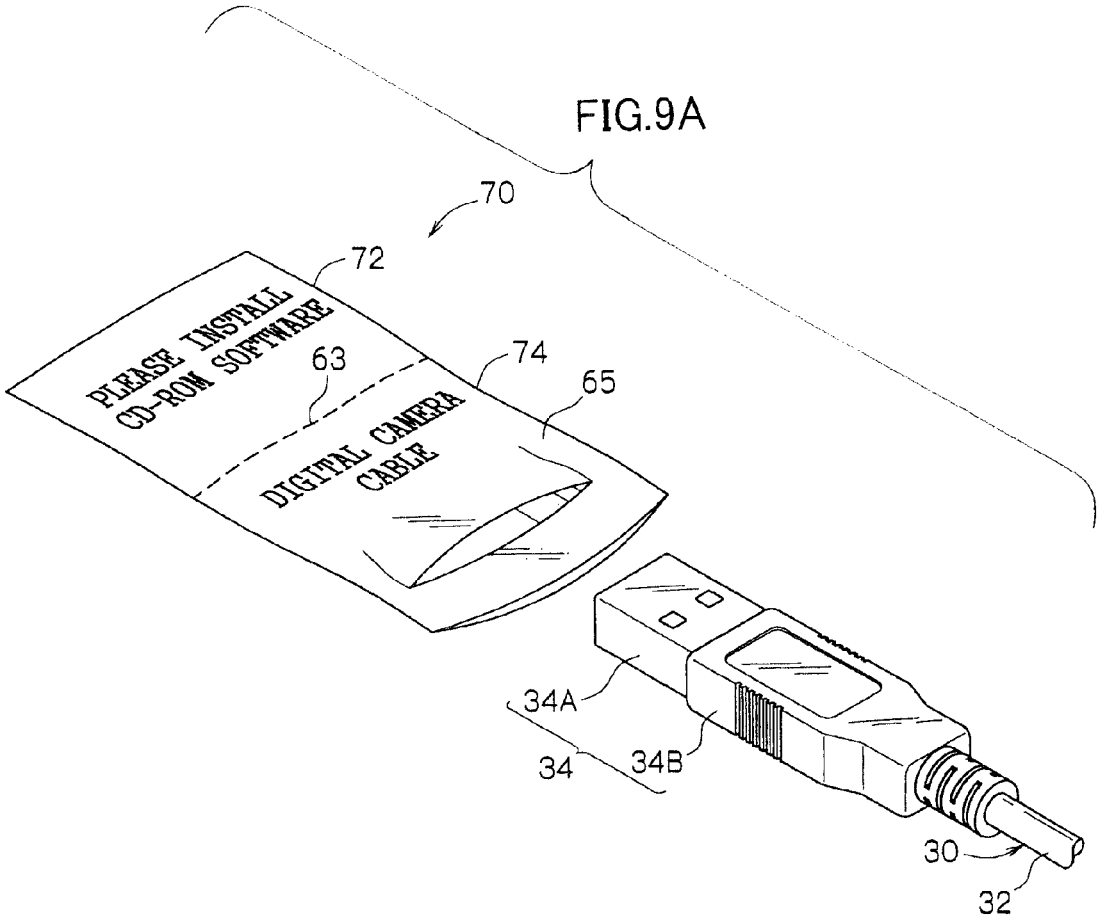
FIG. 9A is a perspective view showing a modified example of the indicator for a connector of FIG. 8A.
Figure 9B:
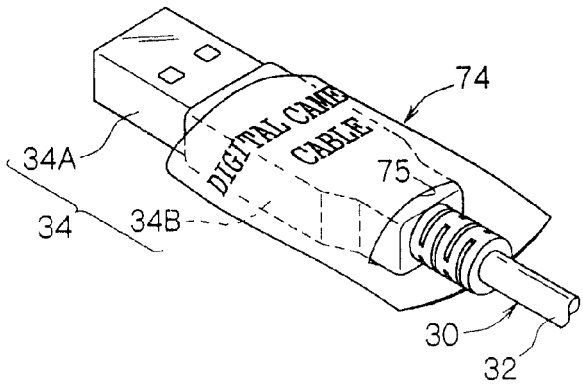
FIG. 9B is a perspective view explaining attachment, to a connector, of the indicator for a connector shown in FIG. 9A.

Note that the configurations of the first indication member and the second indication member are not limited to the above-described configurations. For example, as shown in FIGS. 9A and 9B, an indicator 70 for a connector may be formed in the shape of a bag, such as by a first indication member 72 and a second indication member 74. In this case, a slit is formed in an obverse 65 of the second indication member 74 so as to form an opening 75. By inserting the connector 34 into the second indication member 74 and the first indication member 72 from the opening 75, the indicator 70 for a connector is attached to the connector 34.

After the first indication member 72 and the second indication member 74 are separated at the perforation 63 and the first indication member 72 is removed from the connector 34, as shown in FIG. 9B, only the second indication member 74 remains attached to the connector 34.

Figure 10A:
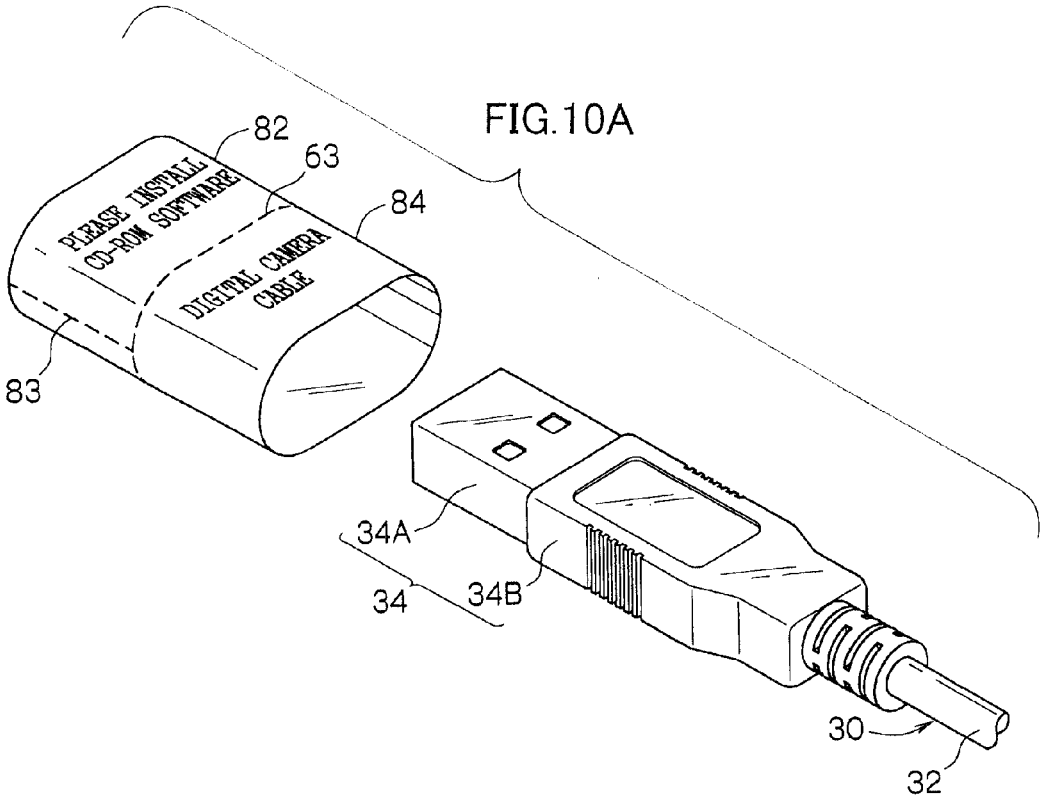
FIG. 10A is a diagram showing another modified example of the indicator for a connector of FIG. 8A.
Figure 10B:
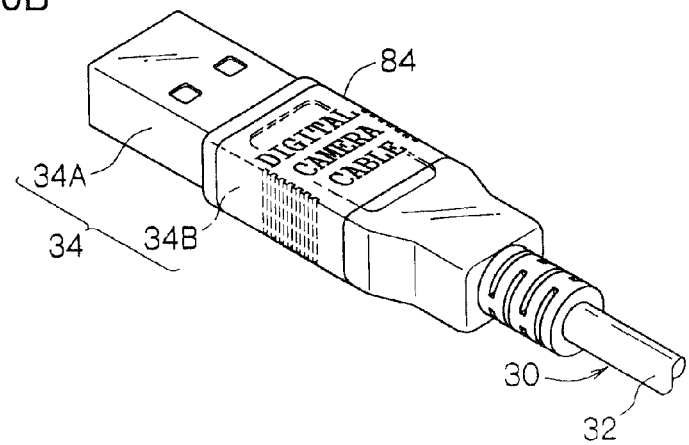
FIG. 10B is a perspective view explaining attachment, to a connector, of the indicator for a connector shown in FIG. 10A.

Further, a tubular structure may be used as in the case of a first indication member 82 and a second indication member 84 shown in FIGS. 11A and 10B. In this case, the first indication member 82 and the second indication member 84 are structured by members which can be shrunk by heat, and are attached to the connector 34 in the same way as the first indication member 46 (see FIGS. 5A and 5B) described in the first embodiment. The removal of the first indication member 82 from the connector 34 by the user can be carried out by ripping apart a perforation 83 and a perforation 63.

After the first indication member 82 has been removed from the connector 34, as shown in FIG. 10B, only the second indication member 84 remains attached to the connector 34.

Figure 11:
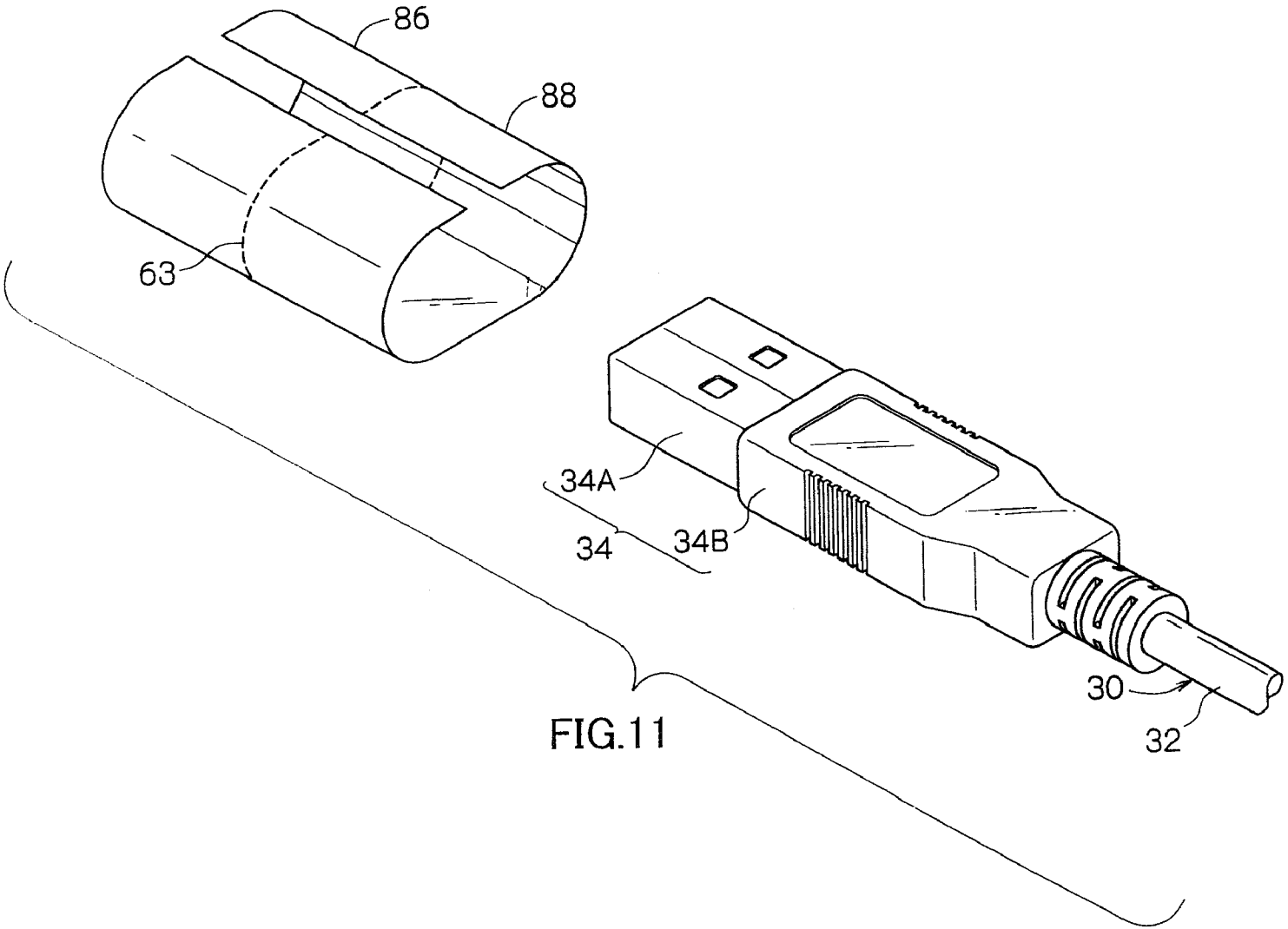
FIG. 11 is a perspective view showing a modified example of the indicator for a connector shown in FIG. 10A.

Moreover, a structure is possible in which respective portions of the reverse sides of the above -described first indication member 82 and second indication member 84 are cut away, as in the case of a first indication member 86 and a second indication member 88 shown in FIG. 11. In this case as well, the first indication member 86 and the second indication member 88 are attached to the connector 34 in the same way as the first indication member 82 and the second indication member 84. Further, the removal of the first indication member 86 from the connector 34 by the user is carried out by ripping apart the perforation 63.

Note that the first indication member 82 and the second indication member 84 shown in FIGS. 10A and 10B, and the first indication member 86 and the second indication member 88 shown in FIG. 11 may be adhered and attached to the connecting portion 34A of the connector 34 by an adhesive, rather than by being heat shrunk.

Figure 12A:
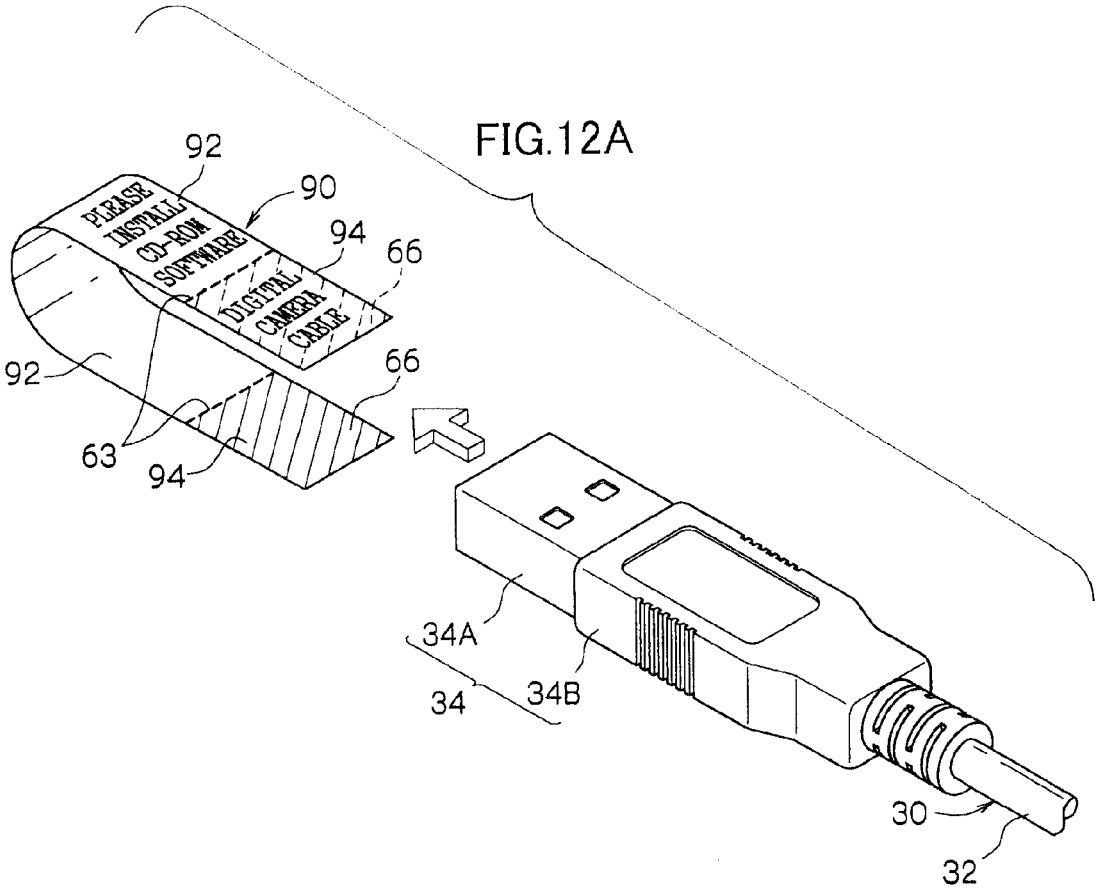
FIG. 12A is a perspective view showing yet another modified example of the indicator for a connector of FIG. 8A.
Figure 12B:
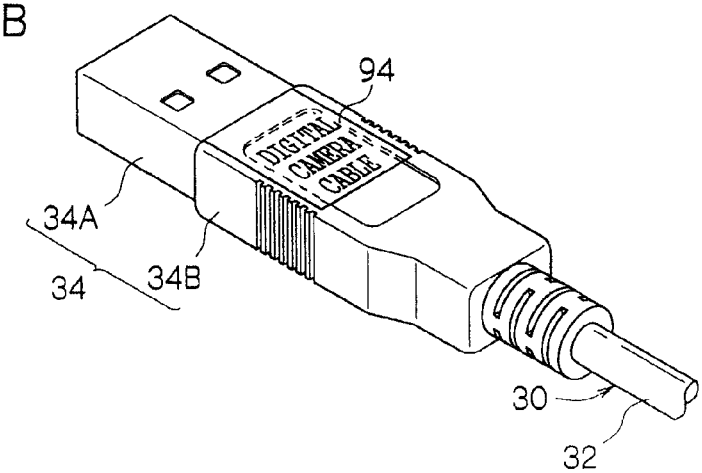
FIG. 12B is a perspective view explaining attachment, to a connector, of the indicator for a connector shown in FIG. 12A.
Figure 13:
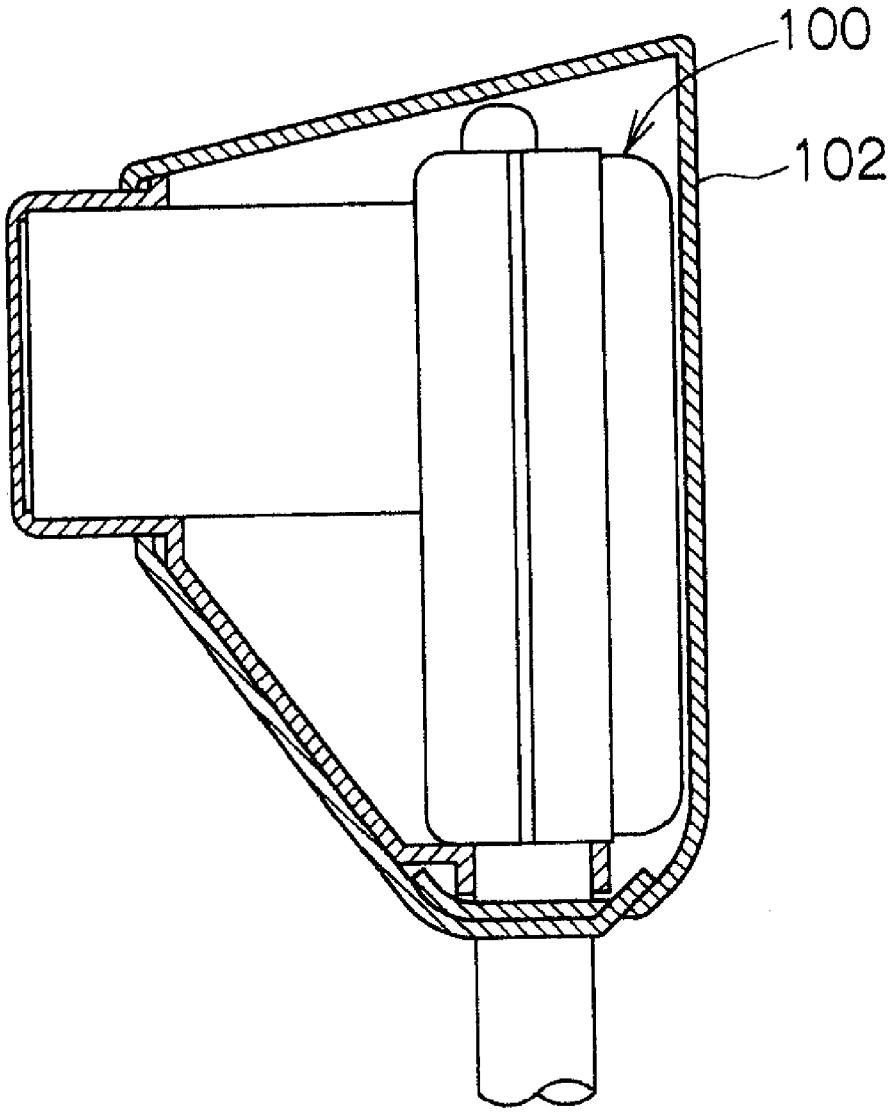
FIG.13 PRIOR ART
FIG. 13 is a diagram showing a conventional indicator for a connector.
Figure 14:
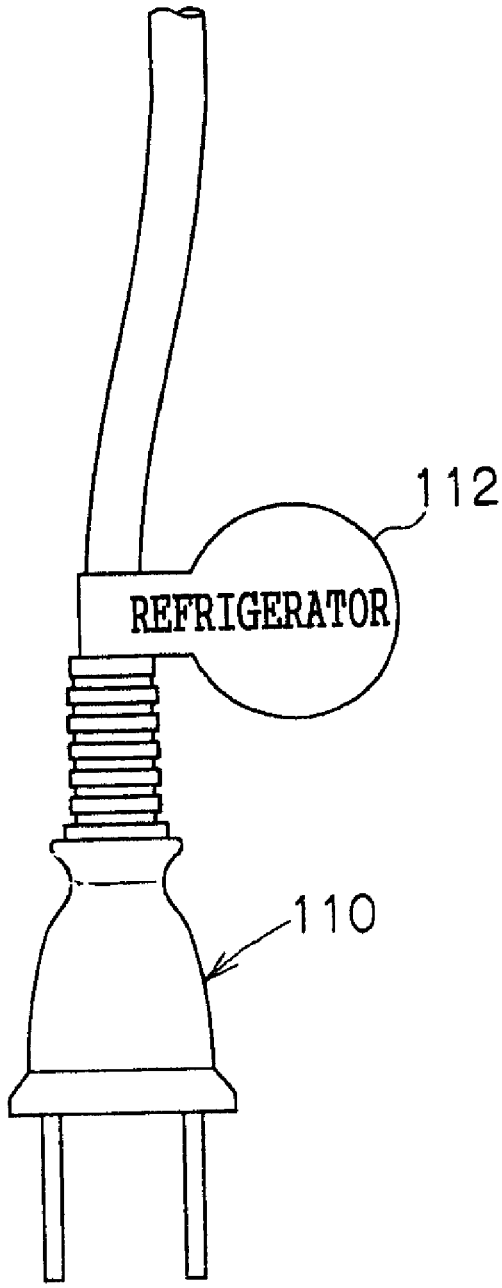
FIG.14 PRIOR ART
FIG. 14 is a diagram showing a conventional indicator for a connector.
Figure 15:
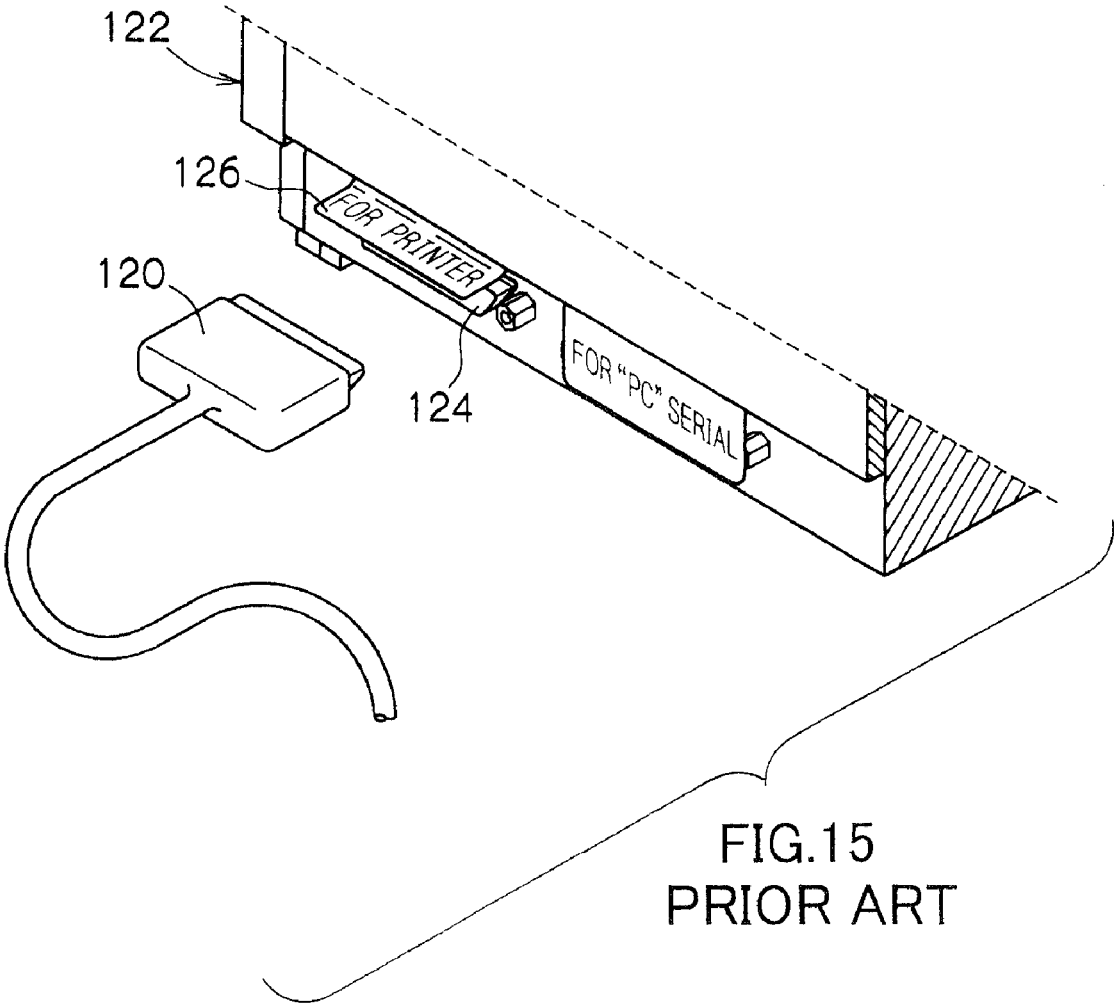
FIG.15 PRIOR ART
FIG. 15 is a diagram showing a conventional indicator for a connector.

Moreover, the first indication member and the second indication member may be formed in a U-shape as in the case of a first indication member 92 and a second indication member 94 shown in FIGS. 12A and 12B. In this case, the adhesion portions 66 are provided at the inner sides of the second indication member 94. An adhesive is applied to the adhesion portions 66, and the adhesion portions 66 are adhered to the grasping portion 34B such that an indicator 90 for a connector is attached to the connector 34. The removal of the first indication member 92 from the connector 34 by the user can be carried out by the user ripping the perforation 63 apart.

After the first indication member 92 is removed from the connector 34, as shown in FIG. 12B, only the second indication member 94 remains attached to the connector 34.

Further, in the present embodiment, the second information indicates that the cable 30 is a cable for a digital cameral. However, the second information is not limited to applications for cables in this way. In addition thereto, do not wet, do not bend, do not connect, the type of the connector, or the like may be used as the second information.

Moreover, in the present embodiment, description is given of an example in which the first indication member and the second indication member are structured integrally. However, the first indication member and the second indication member may be separate members. In particular, by utilizing an integral structure, the number of parts can be reduced and the indicator for a connector can be manufactured more easily, as compared with a case in which the first indication member and the second indication member are separate members.

As described above, in accordance with the indicator for a connector of the present invention, the first indication member can be removed from the connector, and is attached to a position at which it is not possible to connect the connector if the user does not remove the indicator for a connector. Therefore, the user can effectively be urged to perform a predetermined operation before using the connector. Moreover, when the connector is to be used, the first indication member is removed by the user, and at times of use thereafter, the user is not urged to carry out the predetermined operation. Therefore, it is possible to urge the user to carry out the predetermined operation only a single time before the user uses the connector.

What is claimed is:

1. A cable connecter with an indicator, the cable connector comprising:

a body, a connecting portion which extends outward, a first indication member at which is indicated first information urging a user to perform a predetermined operation before using the connector, and which is firmly sealed to the connecting portion, such that the connector cannot be connected if the user does not remove the indicator, and which can be removed from the connector, wherein the first indication member is formed in a shape of a tube, and is attached to the connector due to the connector being inserted through an interior of the tube, and the first indication member has a perforation in a tube axis direction to remove the indicator from the connector.

2. The indicator for a connector of claim 1, wherein the first indication member is attached to the connector by an adhesive.

3. The indicator for a connector of claim 1, wherein the first indication member is formed by a member which can be shrunk by heat, and the first indication member is attached to the connector by being shrunk.

4. A method of manufacturing a cable connector with an indicator, the method comprising:

forming a body, forming a connecting portion forming a first indication member at which is indicated first information urging a user to perform a predetermined operation before using the connector, the first indication member being structured in a shape of a tube and having a perforation in a tube axis direction to remove the indicator from the connector , and sealing the first indication member to the connecting portion of the connector by inserting the connecting portion of the connector through an interior of the tube, wherein the first indication member is structured so as to be attached to a position such that the connector cannot be connected if the user does not remove the first indication member.

5. The method of manufacturing of claim 4, further comprising a step of applying an adhesive to the first indication member so as to attach the first indication member to the connector by adhesion.

6. The method of manufacturing of claim 4, wherein the first indication member is formed by a member which can be shrunk by heat, and is attached to the connector by being shrunk.

* * * * *